US009086232B1

(12) United States Patent
Read

(10) Patent No.: US 9,086,232 B1
(45) Date of Patent: Jul. 21, 2015

(54) REFRIGERATION SYSTEM HAVING SUPPLEMENTAL REFRIGERANT PATH

(71) Applicant: Robert Michael Read, Vancouver, WA (US)

(72) Inventor: Robert Michael Read, Vancouver, WA (US)

( * ) Notice: Subject to any disclaimer, the term of this patent is extended or adjusted under 35 U.S.C. 154(b) by 0 days.

(21) Appl. No.: 14/517,688

(22) Filed: Oct. 17, 2014

Related U.S. Application Data

(63) Continuation of application No. 13/008,850, filed on Jan. 18, 2011.

(60) Provisional application No. 61/321,457, filed on Apr. 6, 2010, provisional application No. 61/295,968, filed on Jan. 18, 2010.

(51) Int. Cl.

| | |
|---|---|
| ***F25B 41/00*** | (2006.01) |
| ***F25B 41/04*** | (2006.01) |
| ***F25B 49/02*** | (2006.01) |
| ***F25B 45/00*** | (2006.01) |
| *F25B 5/02* | (2006.01) |
| *F25B 41/06* | (2006.01) |

(52) U.S. Cl.
CPC ..... *F25B 41/04* (2013.01); *F25B 45/00* (2013.01); *F25B 49/02* (2013.01); *F25B 5/02* (2013.01); *F25B 41/062* (2013.01); *F25B 41/065* (2013.01); *F25B 2341/0661* (2013.01)

(58) Field of Classification Search
CPC ..... F25B 45/00; F25B 41/04; F25B 5/02; F25B 41/062; F25B 41/065; F25B 2341/0661
USPC ..... 62/174, 197, 199–200, 205–206, 62/211–212, 223–225
See application file for complete search history.

(56) References Cited

U.S. PATENT DOCUMENTS

| | | | | |
|---|---|---|---|---|
| 3,081,606 | A | 3/1963 | Brose et al. | |
| 3,161,029 | A | 12/1964 | Lawrence | |
| 4,517,811 | A | 5/1985 | Atsumi et al. | |
| 4,562,700 | A | 1/1986 | Atsumi et al. | |
| 4,606,198 | A | 8/1986 | Latshaw et al. | |
| 4,718,245 | A | 1/1988 | Steenburgh, Jr. | |
| 4,815,298 | A | 3/1989 | Steenburgh, Jr. | |
| 5,035,119 | A | 7/1991 | Alsenz | |
| 5,168,715 | A | 12/1992 | Nakao et al. | |
| 5,372,013 | A | 12/1994 | Lau et al. | |
| 5,408,841 | A | 4/1995 | Fujiwara et al. | |
| 5,551,249 | A | 9/1996 | Steenburgh, Jr. | |
| 6,397,613 | B1 * | 6/2002 | Izawa et al. | 62/196.4 |
| 7,607,313 | B2 | 10/2009 | Stanke et al. | |
| 7,797,956 | B2 | 9/2010 | Terasaki et al. | |

(Continued)

FOREIGN PATENT DOCUMENTS

| | | | | |
|---|---|---|---|---|
| CA | 2561123 | A1 * | 3/2007 | |
| WO | WO 2010003590 | A2 * | 1/2010 | F25B 49/02 |

*Primary Examiner* — Marc Norman
*Assistant Examiner* — Paolo Gonzalez
(74) *Attorney, Agent, or Firm* — Marger Johnson & McCollom, P.C.

(57) ABSTRACT

A refrigeration system includes a normal refrigerant path arranged between a condenser and an evaporator, and an assist refrigerant path arranged between the condenser and the evaporator, wherein the assist refrigerant path is activated during low ambient conditions. The assist refrigerant path may include a solenoid valve and an expansion valve arranged between the condenser and the evaporator. The assist refrigerant path may be adapted to regulate the evaporator temperature.

15 Claims, 5 Drawing Sheets

(56) References Cited

U.S. PATENT DOCUMENTS

| | | | |
|---|---|---|---|
| 8,136,364 | B2 | 3/2012 | Lifson et al. |
| 2004/0168451 | A1 | 9/2004 | Bagley |
| 2007/0068193 | A1 | 3/2007 | Yoon et al. |
| 2008/0276635 | A1 | 11/2008 | Terasaki et al. |
| 2009/0320506 | A1 | 12/2009 | Lifson et al. |

* cited by examiner

REFRIGERATION SYSTEM HAVING SUPPLEMENTAL REFRIGERANT PATH

This application is a continuation of U.S. application Ser. No. 13/008,850 titled REFRIGERATION SYSTEM WITH LOW AMBIENT ASSIST PATH, filed Jan. 18, 2011, which in turn claims benefit of U.S. Provisional Patent Application Ser. No. 61/295,968 titled LOW AMBIENT ASSIST SYSTEM FOR REFRIGERATION SYSTEMS WITH OUTDOOR CONDENSERS, filed Jan. 18, 2010 and U.S. Provisional Patent Application Ser. No. 61/321,457 titled REFRIGERATION SYSTEMS, filed Apr. 6, 2010, the contents of all of which are incorporated by reference herein.

BACKGROUND

Most commercial refrigeration systems operate on a closed-loop cycle in which refrigerant circulates through a compression, condenser, flow-control device such as an expansion valve or capillary tube, evaporator and back to the compressor. The flow-control device is often arranged to maintain the output temperature of the evaporator at a constant value. Due to pressure differential requirements of standard thermostatic expansion valves, there must be sufficient differential pressure between the head pressure and the suction pressure to enable the expansion valves to feed refrigerant into the evaporator. Under normal operating conditions, there is enough pressure at the outlet of the condenser to enable the flow-control device to maintain a normal amount of refrigerant flow and evaporator pressure.

However, under certain ambient conditions, e.g., low ambient temperature, the pressure at the outlet of the condenser may drop thereby reducing the pressure differential across the expansion valve, and therefore, the amount of refrigerant that can flow through the expansion valve. This may cause various problems including a reduction in the evaporator pressure which, in turn, may reduce the system efficiency, cause short cycling, etc. Therefore, it has been mandatory to install a fan cycling switch or a head pressure control valve in the system.

Some attempts have been made to substitute electronically controlled expansion valves including balanced port valves, for mechanical valves, but the results devices have proven unworkable due to problems such as high complexity, bulky construction, and unreliable operation.

DETAILED DESCRIPTION

Figure 1:
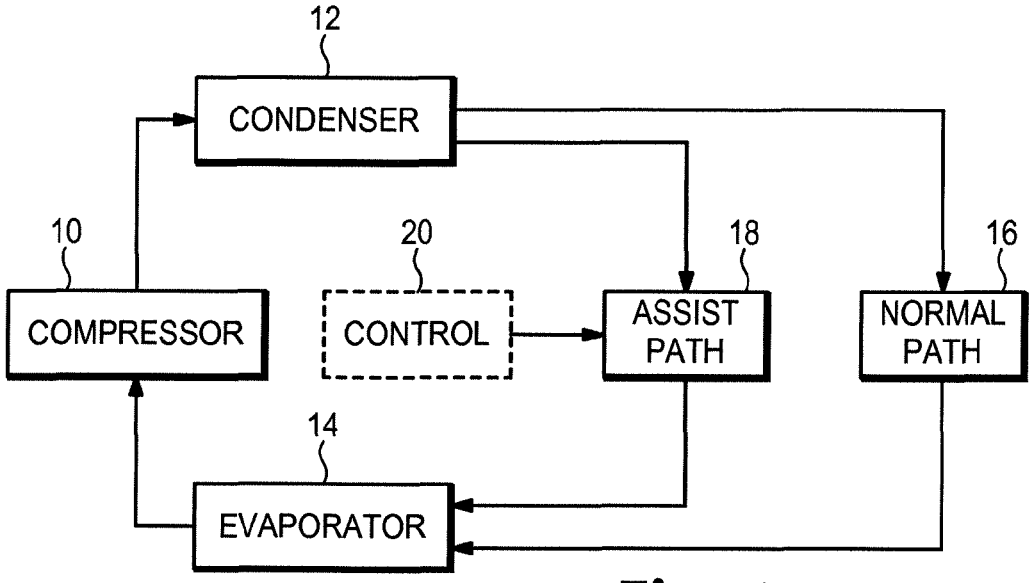
FIG. 1 illustrates an embodiment of a refrigeration system according to some inventive principles of this patent disclosure.

FIG. 1 illustrates an embodiment of a refrigeration system according to some inventive principles of this patent disclosure. The embodiment of FIG. 1 includes a compressor 10, a condenser 12 and an evaporator 14 arranged in a conventional manner with the compressor coupled between the condenser and the evaporator. A normal refrigerant path 16 is arranged between the condenser and the evaporator, and an assist refrigerant path 18 is arranged between the condenser and the evaporator. The normal refrigerant path 16 may include any suitable flow-control devices or devices such as evaporators, capillary tubes, etc. The assist refrigerant path 18 is activated during low ambient conditions. The assist refrigerant path may include a solenoid valve arranged between the condenser and the evaporator, along with one or more expansion valves, capillary tubes or other flow-control devices. The refrigerant path may be adapted to regulate the evaporator temperature.

The embodiment of FIG. 1 may further include a controller adapted to control the assist refrigerant path. The controller may include a pressure switch, an electronic assembly, pressure transducer, and other components as described below.

According to some additional inventive principles of this patent disclosure, a method for operating a refrigeration system may include transferring normal refrigerant from a condenser to an evaporator under normal operating conditions; and transferring additional refrigerant from the condenser to the evaporator in response to an ambient condition. The ambient condition may include a low ambient temperature. Transferring normal refrigerant flow may include regulating a parameter of the evaporator. The parameter may include, for example, the output temperature of the evaporator. Transferring the additional refrigerant may enable the system to regulate a parameter of the evaporator to a normal value under the ambient condition. This parameter may include, for example, the evaporator pressure.

According to some additional inventive principles of this patent disclosure, a system may be implemented with a retrofit kit which includes an assist refrigerant path adapted to transfer refrigerant from a condenser to an evaporator, and a controller adapted to activate the assist refrigerant path in response to a low ambient condition. The kit may also include a sensor coupled to the controller to detect the low ambient condition. The controller may include a flow-control device such as a valve, and the sensor may include a pressure switch. The controller may also include a valve and an electronic assembly, wherein the sensor includes a pressure sensor. A temperature sensor may arrange to enable the electronic assembly to sense a temperature of the evaporator.

Figure 2:
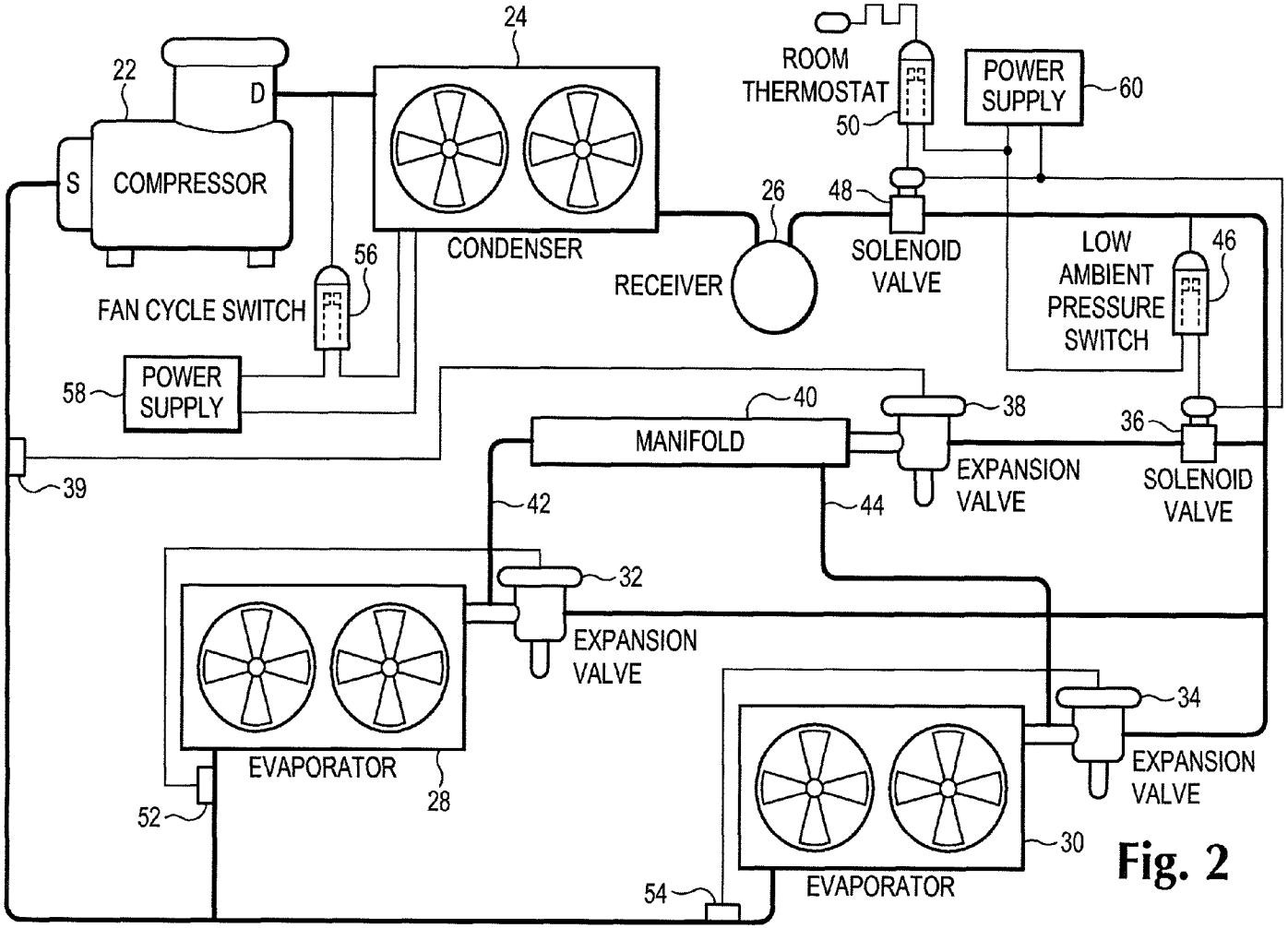
FIG. 2 illustrates an example embodiment of a refrigeration system according to some inventive principles of this patent disclosure.

FIG. 2 illustrates an example embodiment of a refrigeration system according to some inventive principles of this patent disclosure. The embodiment of FIG. 2 includes a compressor 22, condenser 24, receiver 26, dual evaporators 28 and 30 and corresponding thermostatic expansion valves 32 and 34 arranged to form a normal refrigerant path in a conventional manner. The embodiment of FIG. 2, however, also includes an assist refrigerant path that includes a solenoid valve 36, an auxiliary thermostatic expansion valve 38 which is controlled by a thermal sensor 39, a manifold 40, and two delivery tubes 42 and 44, which may be capillary tubes. The solenoid valve 36 is controlled by a pressure switch 46 that measures the head pressure. Power supplies 58 and 60 provide power to the various electric components.

During normal operation, the assist refrigerant path is kept inactive by the pressure switch 46 when the high side pressure is above its set point. When a drop in the ambient temperature causes a sufficient drop in the high side pressure, the pressure switch 46 is activated and causes the solenoid valve 36 to open. Refrigerant then flows through the expansion valve 38 which fills the manifold 40 with refrigerant and allows the capillary tubes 42 and 44 to inject refrigerant into the evaporators. The manifold maintains equal pressure in the delivery tubes. As refrigerant from the normal expansion valves 32 and 34 and the delivery tubes 42 and 44 enters the evaporator, the refrigerant begins evaporating and moving toward the compressor. As the temperature at the evaporator outlet drops, the thermal sensors 52 and 54 of the normal expansion valves begin to regulate refrigerant flow. This flow regulation continues and keeps the evaporator pressure normal as the head pressure floats with the ambient. When extremely low ambient temperature occurs, the head pressure drop is kept to a minimum through the use of a condenser fan cycle switch 56.

When the refrigerated area reaches its design temperature, a thermostat 50 deactivates a second solenoid valve 48 on the liquid line, thereby causing the system to pump down until a low pressure switch turns off the compressor. A sufficient rise in ambient temperature causes an increase in head pressure above the setting of the pressure switch 46, thereby turning off the solenoid valve 36 and deactivating the assist refrigerant path until another low ambient event occurs.

The embodiment of FIG. 2 may enable refrigeration systems with ambient cooled condensers to operate more efficiently when outdoor temperatures drop. Efficiency may be achieved for several reasons: a system operating with low discharge pressure reduces compressor current consumption; sub-cooling of the liquid line may in crease the refrigerating effect and shorten system run time; and refrigerant flow to the evaporators is regulated for high efficiency even at low head pressure. Moreover, running compressor heads at reduced temperature lengthens valve and oil life.

Figure 3:
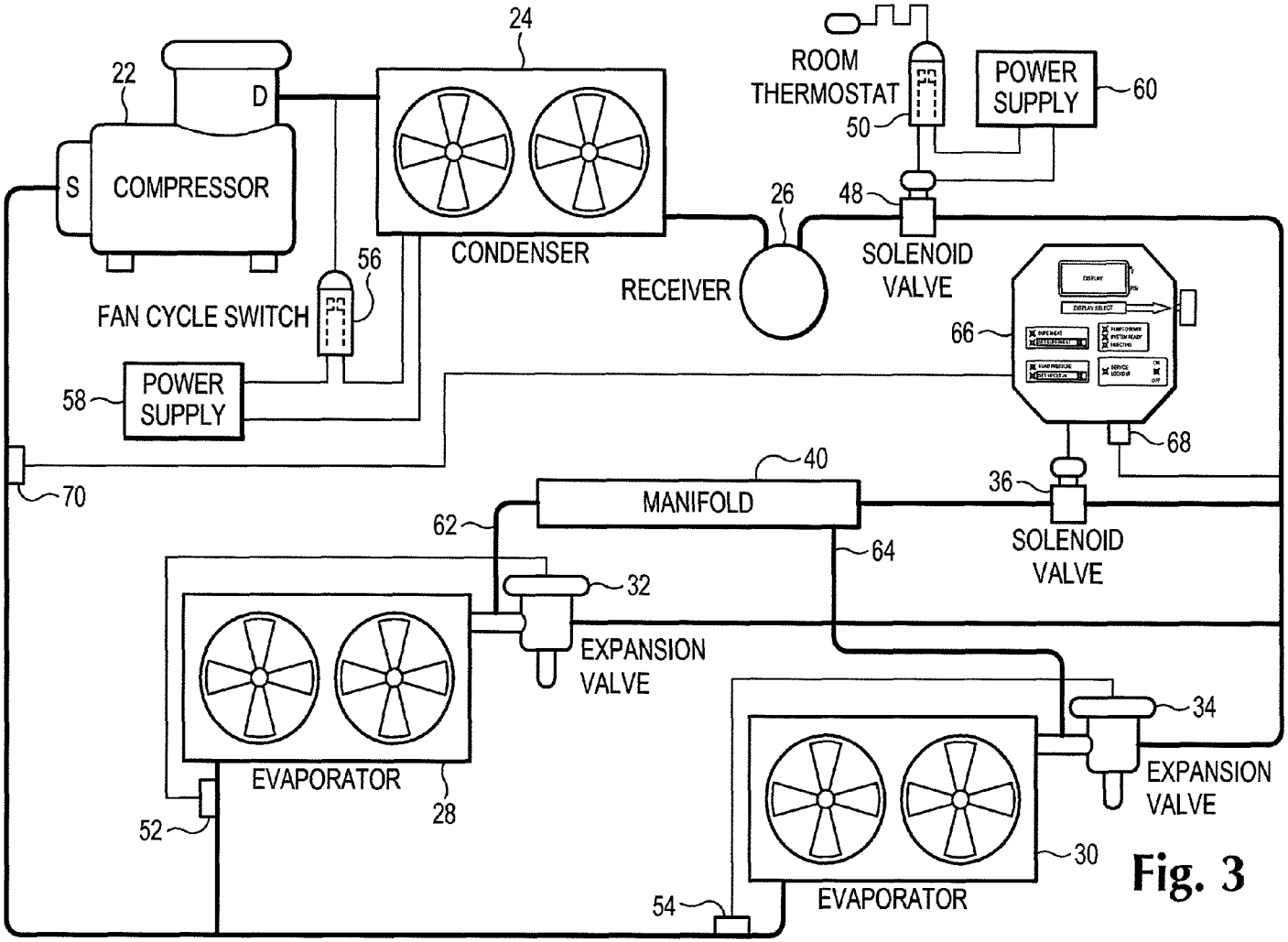
FIG. 3 illustrates another example embodiment of a refrigeration system according to some inventive principles of this patent disclosure.

FIG. 3 illustrates another example embodiment of a refrigeration system according to some inventive principles of this patent disclosure. The embodiment of FIG. 3 includes many of the same components as the embodiment of FIG. 2. However, in the embodiment of FIG. 3, the auxiliary expansion valve 38 is eliminated, and the delivery tubes between the manifold 40 and evaporators 28 and 30 are implemented as capillary tubes 62 and 64, respectively. The solenoid valve 36 is controlled by an electronic module 66 that receives sensor inputs from a temperature transducer 70 attached to the suction line, and a pressure transducer 68 that senses the high side pressure.

During normal operation, the electronic module 66 keeps the solenoid valve 36 closed when the pressure measured by transducer 68 is higher than the cut-in setting, and thus, the assist refrigerant path is kept inactive. When a drop in ambient temperature causes a sufficient drop in the high side pressure, the electronic module opens the solenoid valve 36 if the super heat at the outlet of the evaporator is higher than the cut-in setting. Opening the solenoid valve enables the manifold to fill with refrigerant and allows the capillary tubes to inject refrigerant into the evaporators.

As refrigerant from the normal expansion valves 32 and 34, as well as the capillary tubes 62 and 64 enters the evaporator, it evaporates and moves toward the compressor. As the temperature at the evaporator outlet drops, the thermal sensors of the expansion valves and electronic module begin to regulate the refrigerant flow. The flow regulation continues and keeps the evaporator pressure normal as the head pressure floats with the ambient temperature. When an extremely low ambient temperature occurs, the head pressure drop is kept to a minimum through the use of a condenser fan cycle switch 56.

When the refrigerated area reaches its design temperature, a thermostat 50 deactivates a second solenoid valve 48 on the liquid line, thereby causing the system to pump down until a low pressure switch turns off the compressor. The electronic module detects the pump off cycle and turns off the auxiliary solenoid, thereby deactivating the assist refrigerant path. The electronic module enters a standby mode until another low ambient event occurs.

Depending on the implementation details, the reduced condensing temperature may reduce the amount of electric energy used by a compressor during the ambient conditions and may also increase the capacity of the system with lower liquid temperatures which reduces compressor runtimes. Moreover, lower liquid refrigerant temperatures produce denser refrigerant, thereby providing greater cooler capacity per unit of refrigerant volume. Additionally, the inventive principles may enable the compression ratio of a compressor to be reduced, thereby improving efficiency.

Some possible additional implementation details according to some inventive principles of this patent disclosure are as follows.

Two variables may be within programmed set-points for the floating head system to begin operation: (1) The head pressure may be below a threshold setting. This means that there is a low ambient situation and that the head pressure can float down. (2) The refrigerant temperature at the outlet of the evaporator must exceed the threshold setting. This means that the superheat is higher than desired and the evaporator needs more liquid refrigerant to continue cooling.

The electronic module may monitor the outdoor ambient temperature utilizing a pressure transducer on the liquid line, which is the pressure at the outlet of the condenser (condensing pressure). The electronic module may monitor the refrigerant temperature at the outlet of the evaporator(s) utilizing a temperature sensor attached to the main suction line. When the floating head system engages, the electronic module calculates and then supplies refrigerant to the evaporator(s). This sensor and the thermal bulb of the expansion valve may regulate refrigerant flow and keep evaporator pressure normal as the head pressure ramps down.

A fan cycling switch may be provided with the floating head system kit to be utilized if very low ambient conditions occur (typically below 40 degrees F.). This may help to stabilize head pressure during these conditions, keep the compressor operating is the required pressure envelope and contribute additional energy savings.

The floating head system may be located downstream of the liquid line solenoid, and shut down automatically when the walk-in box or refrigerated case reaches required temperature as dictated by the thermostat. In addition, when the ambient temperature rises and the head pressure exceeds the set-point, the floating head system may shut off until another low ambient event occurs.

The floating head system may be programmed to shut down when the head pressure drops below, for example, 40 psi. This is generally when refrigerated space has reached temperature and the electronic module has pumped down and shut off.

Installation of the floating head system on either retrofit or new projects is easily accomplished by a certified refrigeration technician in a short time with a minimum of downtime.

Figure 4:
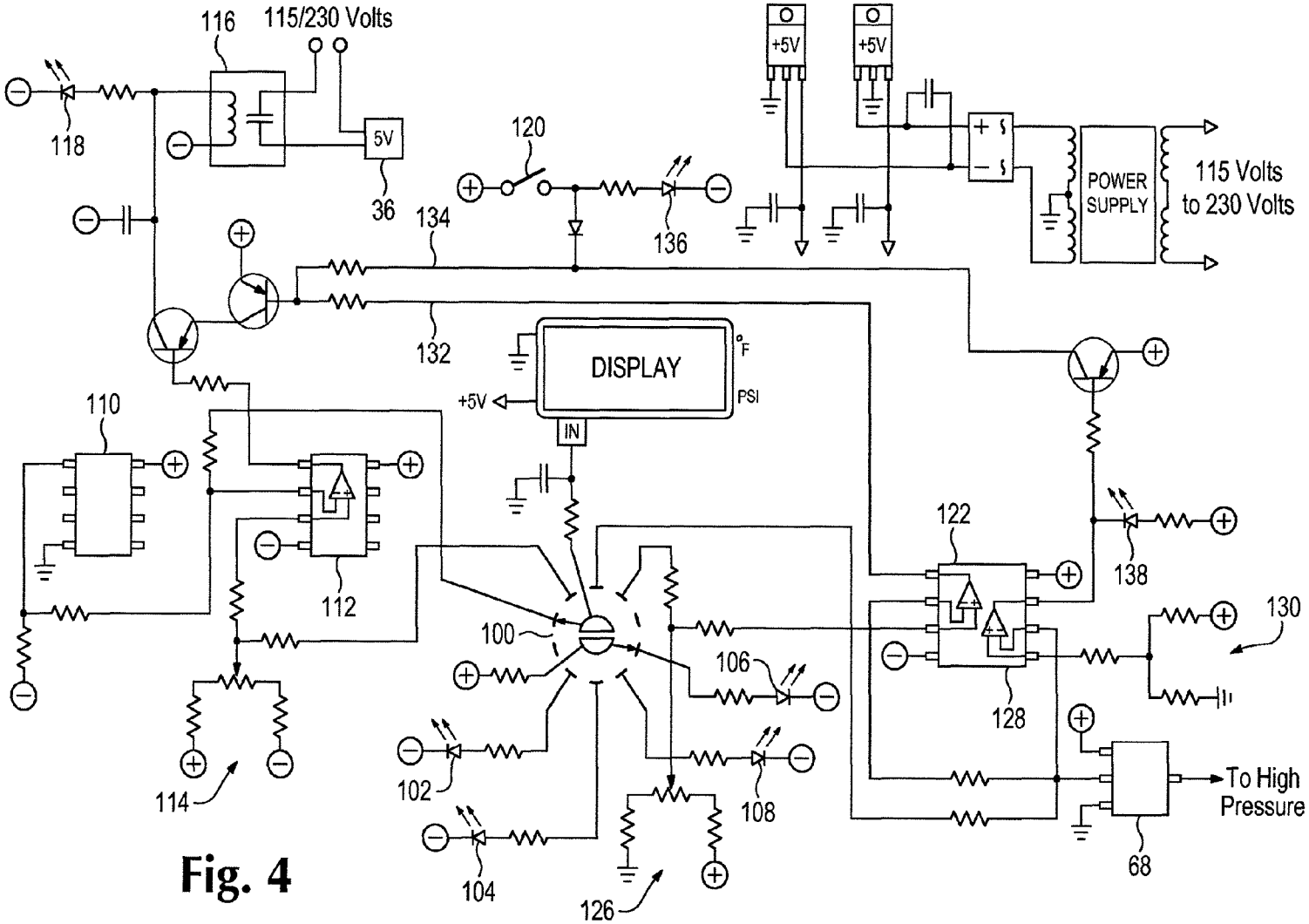
FIG. 4 is a schematic diagram of an embodiment of an electronic control module according to some inventive principles of this patent disclosure.
Figure 5:
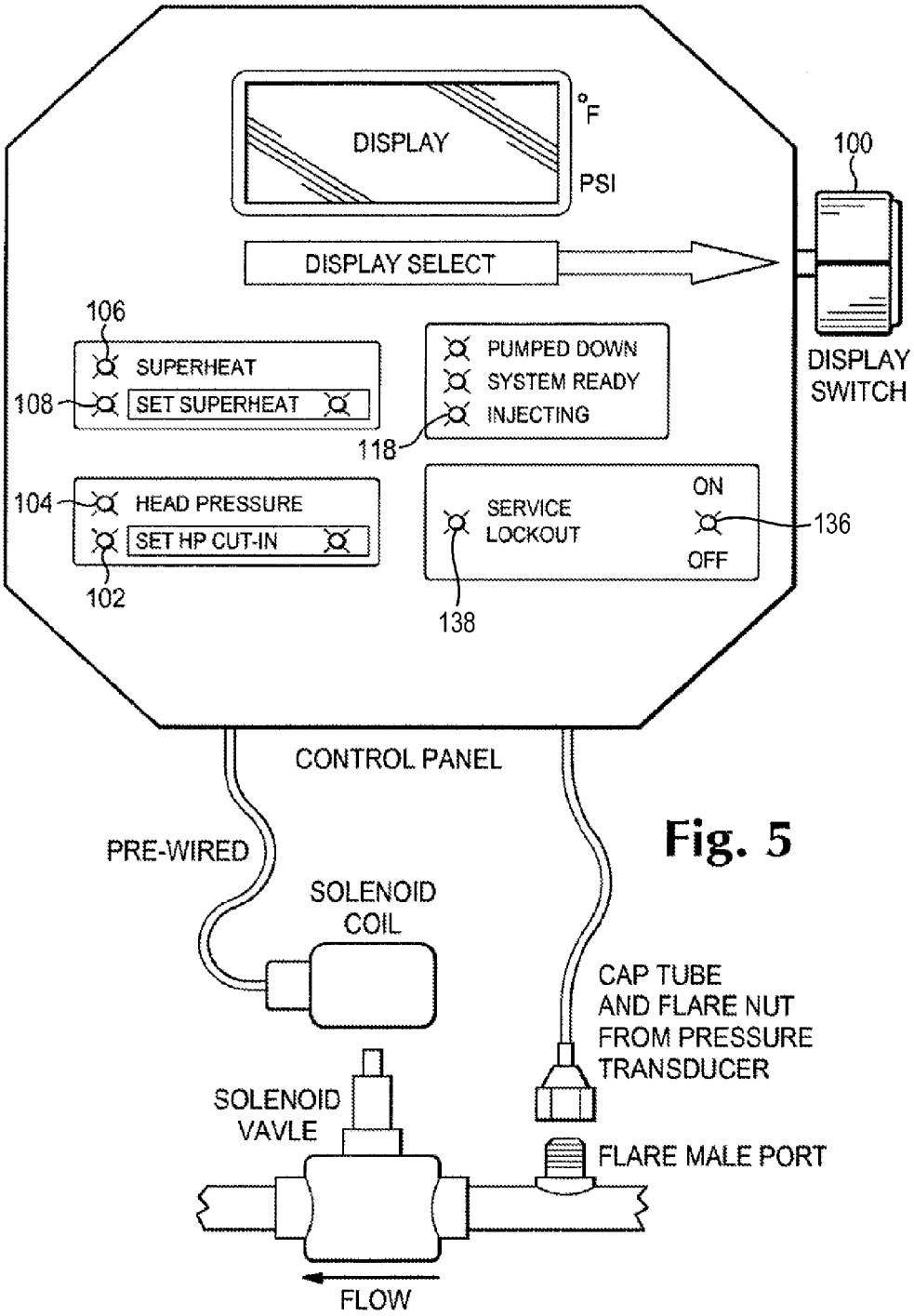
FIG. 5 illustrates a front panel configuration of an electronic control module according to some inventive principles of this patent disclosure.

FIG. 4 is a schematic diagram of an embodiment of an electronic control module according to some inventive principles of this patent disclosure, while FIG. 5 illustrates a front panel configuration of the module. The module of FIGS. 4 and 5 may be used, for example, to implement the module 66 shown in FIG. 3.

Referring to FIG. 4, the module includes a rotary switch 100 which sets the mode of the module and causes the high pressure setting LED 102, high pressure LED 104, superheat indicator LED 106, and superheat setting LED 108 to illuminate depending on the mode. A temperature comparator 112 compares the signals from a temperature sensor 110 and a reference divider 114, and actuates a relay 116, and thus the auxiliary solenoid valve 36, when the reference level is crossed, the manual lock-out switch 120 is open and the low and high pressure lock outs are not activated. A high pressure comparator 122 compares the signals from a pressure-transducer 68 to a reference divider 126 to generate a high pressure lock-out signal 132. A low pressure comparator 128 compares the signals from the pressure transducer 68 to another reference divider 130 to generate a low pressure lock-out signal 134.

The injecting indicator LED 118 illuminates when the relay 116 is actuated. Low pressure lock-out indicator LED 138 and manual lock-out indicator LED 136 illuminate when their respective signals are activated.

Referring to FIG. 5, the indicator LEDs 102-108, 118 and 138-136 are illustrated on the front pane of the module. Rotary switch 100 is shown in the side of the module. Also shown in FIG. 5 are connections for the pressure transducer 68 and auxiliary solenoid valve 36.

The inventive principles of this patent disclosure have been described above with reference to some specific example embodiments, but these embodiments can be modified in arrangement and detail without departing from the inventive concepts. Such changes and modifications are considered to fall within the scope of the following claims.

What is claimed is:

1. A refrigeration system comprising:

a condenser;

an evaporator;

a temperature sensor structured to detect a temperature of the evaporator;

a compressor arranged upstream from the condenser and downstream from the evaporator;

a thermostatic expansion valve coupled between the condenser and the evaporator, and separated from the compressor by the evaporator, and arranged downstream from the condenser and upstream from the evaporator;

a pressure sensor configured to sense a high-pressure of the refrigeration system, the pressure sensor arranged downstream from the condenser and upstream from the evaporator;

a first refrigerant path arranged downstream from the condenser and upstream from the evaporator;

a selectively activated assist refrigerant path arranged downstream from the condenser and upstream from the evaporator, the assist refrigerant path including:

a control valve, and a capillary tube coupled between the control valve and the evaporator, the capillary tube for conveying additional refrigerant to the evaporator; and a controller configured to open the control valve to cause refrigerant to flow through the assist refrigerant path when the sensed pressure falls below a threshold pressure and the sensed temperature is above a threshold temperature.

2. The system of claim 1 where the control valve in the assist refrigerant path is a solenoid valve arranged between the condenser and the evaporator.

3. The system of claim 1 where the controller includes an electronic assembly.

4. The system of claim 3 where the controller includes a pressure transducer.

5. The system of claim 1 where the controller includes a sensor input.

6. The system of claim 1 where the controller includes a pressure sensor input and includes a temperature sensor input.

7. A cooling system operative over a variety of operating conditions, the system comprising:

a first refrigerant path arranged downstream from a condenser and upstream from an evaporator; and a selectively activated assist refrigerant path coupled in parallel to the first refrigerant path, and arranged downstream from the condenser and upstream from the evaporator, the assist refrigerant path adapted to transfer an amount of refrigerant from the condenser to the evaporator that is in addition to an amount already being transferred through the first refrigerant path;

a controllable valve;

a temperature sensor structured to detect a temperature of the evaporator;

a sensor configured to detect a high-side pressure of the cooling system; and a controller configured to activate the assist refrigerant path when the detected high-side pressure falls below a threshold and a sense temperature is above a threshold temperature.

8. The system of claim 7 where the sensor comprises a pressure switch.

9. The system of claim 7 where:

the controller comprises an electronic assembly; and the sensor comprises a pressure sensor.

10. The system of claim 7 in which the assist refrigerant path comprises a capillary tube.

11. A method for operating a refrigeration system comprising:

flowing a first amount of refrigerant from a condenser to an evaporator in the refrigeration system under a first set of operating conditions; and, after flowing the first amount of refrigerant:

sensing a high-side pressure in the refrigeration system between the condenser and the evaporator, comparing the sensed pressure to a threshold pressure, and operating a mechanical valve to open an auxiliary refrigerant path through a capillary tube located between the condenser and the evaporator, when the sensed pressure falls below the threshold pressure, the capillary tube structured to carry the additional refrigerant between the condenser and the evaporator; and sensing a temperature at an output of the evaporator; and in which the mechanical valve is operated only when both the sensed pressure falls below the threshold pressure and when the sensed temperature is above a threshold temperature.

12. A refrigeration system, comprising:

a compressor coupled to an evaporator through both a high pressure path and a low pressure path;

a condenser coupled between the compressor and the evaporator within the high pressure path;

a controllable assist path coupled between an output of the condenser and an input of the evaporator in parallel to a first portion of the high pressure path disposed between an output of the condenser and the evaporator;

a pressure detector configured to detect a pressure of the first portion of the high pressure path;

a temperature sensor coupled to an output of the evaporator and configured to measure a temperature of the output of the evaporator; and a controller coupled to the pressure detector and to the temperature sensor, the controller configured to open the assist path to cause refrigerant to flow through the assist path when the pressure of the first portion of the high pressure path is below a threshold pressure and when the temperature of the output of the evaporator is simultaneously above a threshold temperature.

13. An evaporator output temperature regulator for a refrigeration system, comprising:

a pressure switch configured to measure a high side pressure of the refrigeration system between an output of a condenser and an input of an evaporator;

a temperature sensor coupled to the output of the evaporator and configured to measure a temperature of the output of the evaporator; and a controller configured to open a controllable assist path for refrigerant when the high side pressure is below a pressure threshold and when the temperature of the output of the evaporator is simultaneously above a temperature threshold, the assist path disposed between the output of the condenser and the input of the evaporator and in parallel with the high side of the refrigeration system.

14. A controllable supplemental assist path system for an existing refrigeration system that has a high side pressure portion between a condenser and an evaporator, the controllable supplemental assist path system comprising:

a pressure switch configured to measure the high side pressure portion of the refrigeration system;

a temperature sensor coupled to the output of the evaporator and configured to measure a temperature of the output of the evaporator; and a controller configured to open a controllable assist path for refrigerant when the high side pressure is below a pressure threshold and when the temperature of the output of the evaporator is simultaneously above a temperature threshold, the assist path disposed between the output of the condenser and the input of the evaporator and in parallel with the high side of the refrigeration system.

15. The controllable supplemental assist path system for an existing refrigeration system of claim 14 in which the assist path comprises a capillary tube.

* * * * *